United States Patent [19]

De Meyer et al.

[11] 4,383,540

[45] May 17, 1983

[54] FEEDING MECHANISM FOR DUAL COIN SORTERS OPERATING IN PARALLEL

[75] Inventors: Roy W. De Meyer, Oconomowoc; Frederick H. Harder; Arnold R. Buchholz, both of Watertown; Richard P. Uecker, Juneau; John A. Kressin, Watertown, all of Wis.

[73] Assignee: Brandt, Inc., Watertown, Wis.

[21] Appl. No.: 260,215

[22] Filed: May 4, 1981

[51] Int. Cl.[3] ..... G07D 3/00

[52] U.S. Cl. ..... 133/3 H; 133/4 A

[58] Field of Search ..... 133/4 A, 3 R, 3 E, 3 F, 133/3 H; 194/DIG. 14; 193/29, 31; 198/569, 368

[56] References Cited

U.S. PATENT DOCUMENTS 3,196,257 7/1975 Buchholz et al. .

3,916,922 11/1975 Prumm ..... 133/3 R 3,998,237 12/1976 Kressin et al. .

4,275,751 6/1981 Bergman .

*Primary Examiner*—Stanley H. Tollberg

*Attorney, Agent, or Firm*—Quarles & Brady

[57] ABSTRACT

A coin processing machine includes a hopper that empties into a coin splitting chute with divergent spouts to deliver a half batch of coins to each of two coin sorters operating in parallel. The receptacle is disposed on a counter top to discharge coins along a coin feeding path from the receptacle to the coin splitting chute. Feed control elements extend into the coin feeding path and are responsive to signals from the coin sorters for controlling the delivery of batches of coins to the coin splitting chute. In a first embodiment a trap door at the bottom of the hopper is operated to feed a second batch of coins into the coin sorters while a third batch is dumped into the hopper from a hinged inspection tray. In a second embodiment, larger batches of coins are carried from the receptacle to the hopper by a motor-driven conveyor to which power is interrupted in response to an excess flow of coins which is sensed within the coin sorters.

5 Claims, 12 Drawing Figures

FEEDING MECHANISM FOR DUAL COIN SORTERS OPERATING IN PARALLEL

BACKGROUND OF THE INVENTION

The field of the invention is coin sorting/counting machines of the type that quickly and automatically sort coins in various denominations while providing a print-out or visual display of the accumulated totals of the coins being sorted.

As described in Kressin et al., U.S. Pat. No. 3,998,237, issued Dec. 21, 1976, there have been a number of coin sorters in the art that have utilized rotating discs through which coins are sorted into denominations for counting and/or packaging. The sorter of Kressin et al. uses a high-speed rotating disc to distribute coins by centrifugal force to its circumference where they are picked off by plows, which are styled according to the various denominations of coins to be picked off.

Another type of rotating disc sorter is a "core" sorter of the type disclosed in Buchholz et al., U.S. Pat. No. 3,196,257, issued July 20, 1965 and Bergman, U.S. Pat. No. 4,275,751, issued June 30, 1981. In this type of sorter, coins are fed into a rotating disc with a scalloped edge and then dropped through an opening into a series of coin receiving slots. The interiors of the slots each form a series of graduated ledges so that larger coins are caught at a higher level then smaller coins. This type of sorter has a coin sorting rate which is substantially less than the rate for the sorter in U.S. Pat. No. 3,998,237, however, the feeding mechanism and interaction with the operator must also be considered in the overall processing rate for equipment employing such a sorter.

In U.S. Pat. No. 3,998,237, the coin sorting machine has a rotary feeding device with a pocket for receiving a first batch of coins. The feeder is then rotated to dump the first batch of coins onto the sorting disc, while the feeder receives a second batch of coins in another pocket. The coin sorter, however, may be idle between batches, and the operator may not be able to keep pace with the feeder, thus limiting the overall processing rate for the machine. The "core" type sorter described above is slower and less expensive than the high speed sorter of Kressin et al., but with improvements in batch feeding, the overall processing rate for a machine using such a sorter could be comparable to the rate for machines using higher speed sorters.

SUMMARY OF THE INVENTION

The invention is embodied in a coin processing machine with vertical batch feeding to a pair of coin sorters that can be operated in parallel. The machine employs a coin splitting chute that divides the batch of coins into two portions, and each portion is fed to a respective coin sorter. The coins are fed to the coin splitting chute along a coin feeding path which extends from a receptacle on top of the apparatus, through a coin hopper and into the chute. Feed control means extend into the coin feeding path and are responsive to signals from the coin sorters to control the delivery of coins through the coin splitting chute.

In a first embodiment the invention is incorporated in a coin processing machine that allows three batches of coins to be processed at one time. The hopper is provided with a trap door so that as a first batch of coins is being processed by the coin sorters, a second batch may be held in the hopper. An actuator is provided to move the hopper door between an open position and a closed position. Electronic means are coupled between the coin sorters and the actuator and are responsive to the completion of sorting of the first batch of coins to generate a signal to the actuator to open the hopper door and allow the second batch of coins to flow through the coin splitting chute to the sorters. The door is then automatically closed and a third batch of coins may be received from the receptacle, which includes a tray pivotally mounted adjacent the mouth of the hopper so that an opposite end can be manually lifted to deliver the third batch of coins to the hopper.

In its first embodiment, the invention allows a second batch of coins to be staged below the counter top in which the hopper is supported, and therefore provides room for loading a third batch of coins into the inspection tray that is hinged to the counter top. In its first embodiment the invention provides a vending route coin processing machine for processing three batches of coins simultaneously.

In a second embodiment, the receptacle is disposed on a counter top and is provided with a motor-driven coin conveyor for automatically feeding coins into the hopper. In this embodiment the conveyor is provided as an alternative to the hopper door for controlling the delivery of coins to the coin chute. The coin sorters includes sensor means to limit the number of coins being processed by the sorters, these sensors being coupled in an electrical circuit with the motor on the conveyor to interrupt operation of the conveyor when necessary to prevent an excess flow of coins into the sorters. In this embodiment, the invention provides a machine for accepting relatively larger batches of coins than in the first embodiment. Such a machine is preferred in banks and other financial institutions.

One object of the invention is to provide high speed coin processing through incorporation of two coin sorters in parallel operation.

Another object of the invention is to provide efficient means for feeding batches of coins to an apparatus employing two coin sorters in parallel operation.

Another object of the invention is to reduce the mechanical complexity of batch feeding mechanisms.

Another object of the invention is to provide means for feeding collections of coins in batches, while controlling the concentration of coins being sorted and counted.

The foregoing and other objects and advantages of the invention will appear from the following description. In the description, reference is made to the accompanying drawings which form a part hereof, and in which there is shown by way of illustration two preferred embodiments of the invention. Such embodiments do not necessarily represent the full scope of the invention, however, and reference is therefore made to the claims for interpreting the scope of the invention.

DESCRIPTION OF THE PREFERRED EMBODIMENTS

Figure 1:
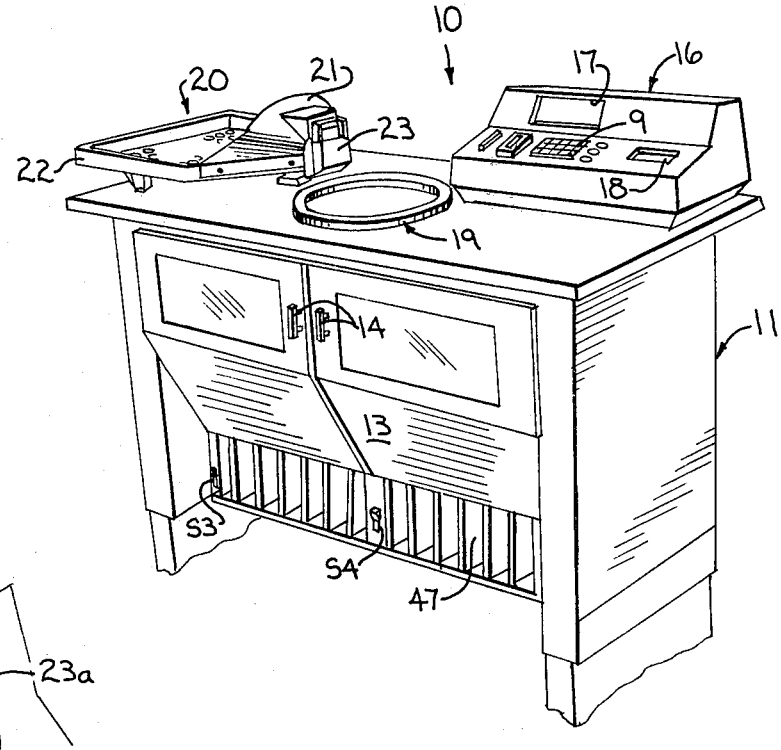
FIG. 1 is a perspective view of a coin sorting machine that is a first embodiment of the present invention.
Figure 2:
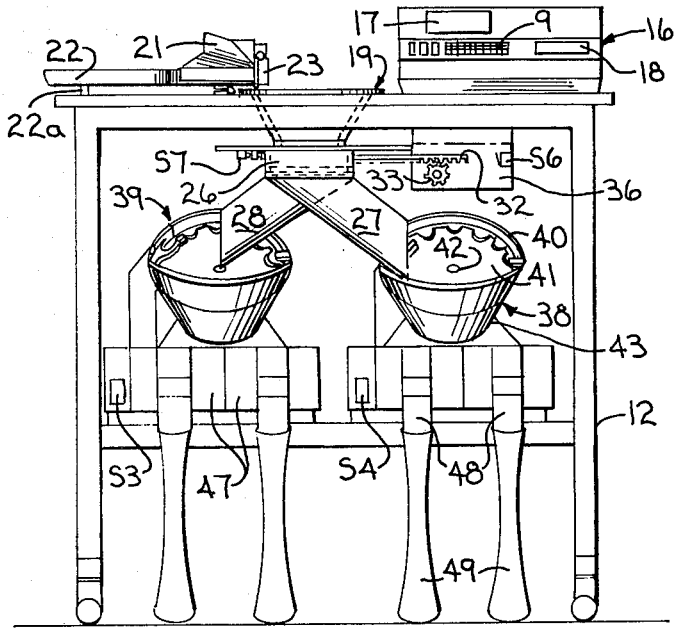
FIG. 2 is a front view of the machine of FIG. 1 with its cabinet doors removed.

FIGS. 1 and 2 show a first preferred embodiment of a portable coin sorting/counting machine 10 that incorporates the present invention. The machine 10 has a cabinet 11 fabricated primarily of sheet metal that is attached to a wheeled, metal frame 12 which is seen in FIG. 2. The cabinet 11 has doors 13 that are hinged along their outside vertical edges, so that they may be opened by pulling outwardly on the handles 14 attached near their inside vertical edges. The doors 13 are provided with windows for viewing the components inside, and with an electrical door interlock (not seen in FIGS. 1 and 2) so that power to the components within the cabinet will be interrupted when the doors 13 are opened.

Still referring to FIGS. 1 and 2, a counter top 15 is fastened to the top of the frame 12 to provide a horizontal work surface for an operator. An electronic totalizer 16 is disposed on the back right portion of the counter top 15 and is connected through a cord (not shown) to the electrically operated components in the interior of the cabinet 11. The totalizer 16 includes an eight-digit LED display and various status indicator lights 17 to provide visual results, and a paper tape printer 18 to provide printed results. Such results include totals for various denominations as well as certain information identifying a batch in which coins are collected for sorting and counting. A keyboard 9 is located below the visual display and status lights 17 and to the left of the paper tape printer 18. The detachable totalizer 16 is commercially offered by the assignee of the present invention as its MICROSORT TM Totalizer, and only those modifications which relate to the present invention will be described herein.

Figure 4:
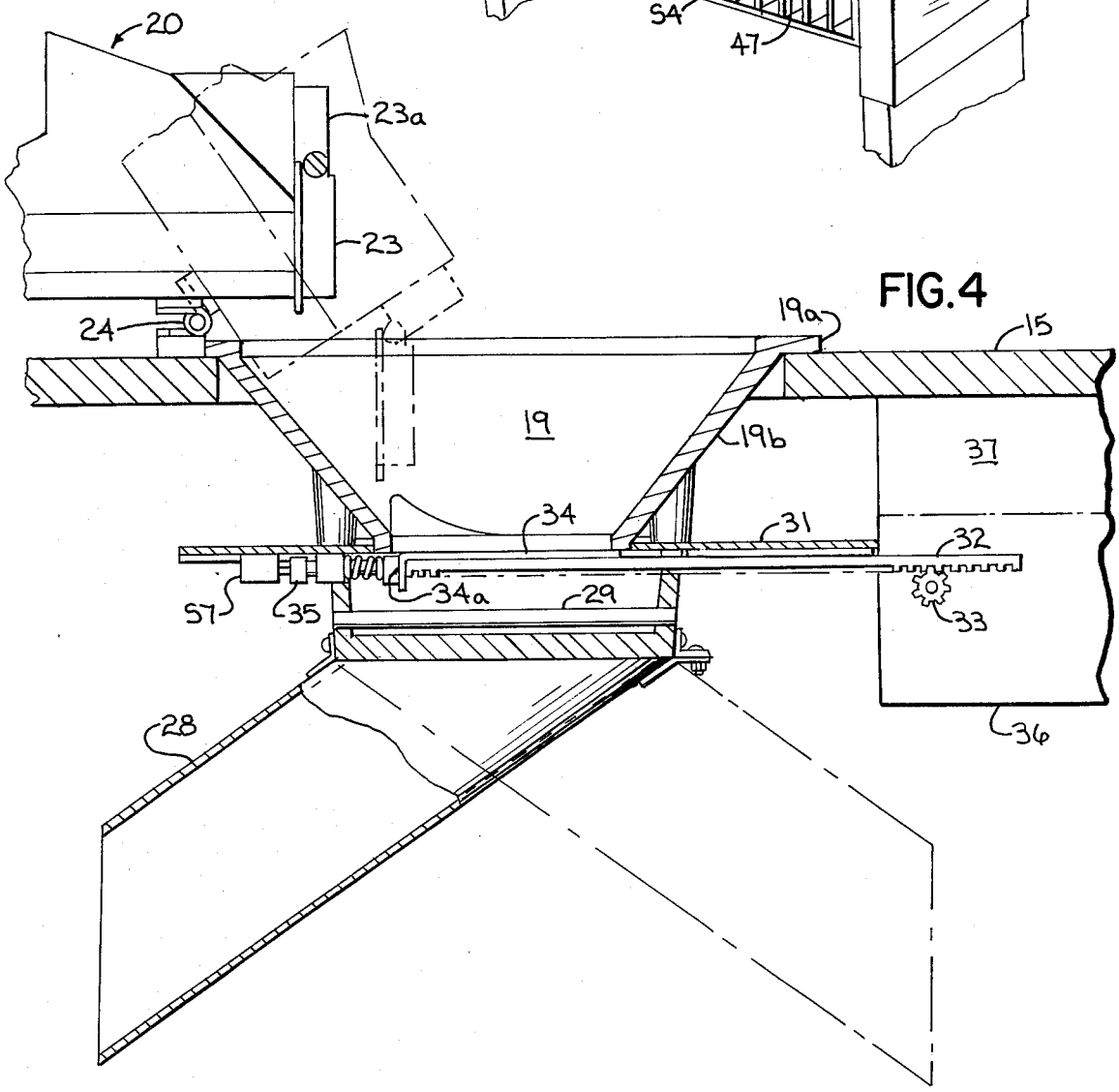
FIG. 4 is a sectional view taken in the plane indicated by line 4—4 in FIG. 3.
Figure 5:
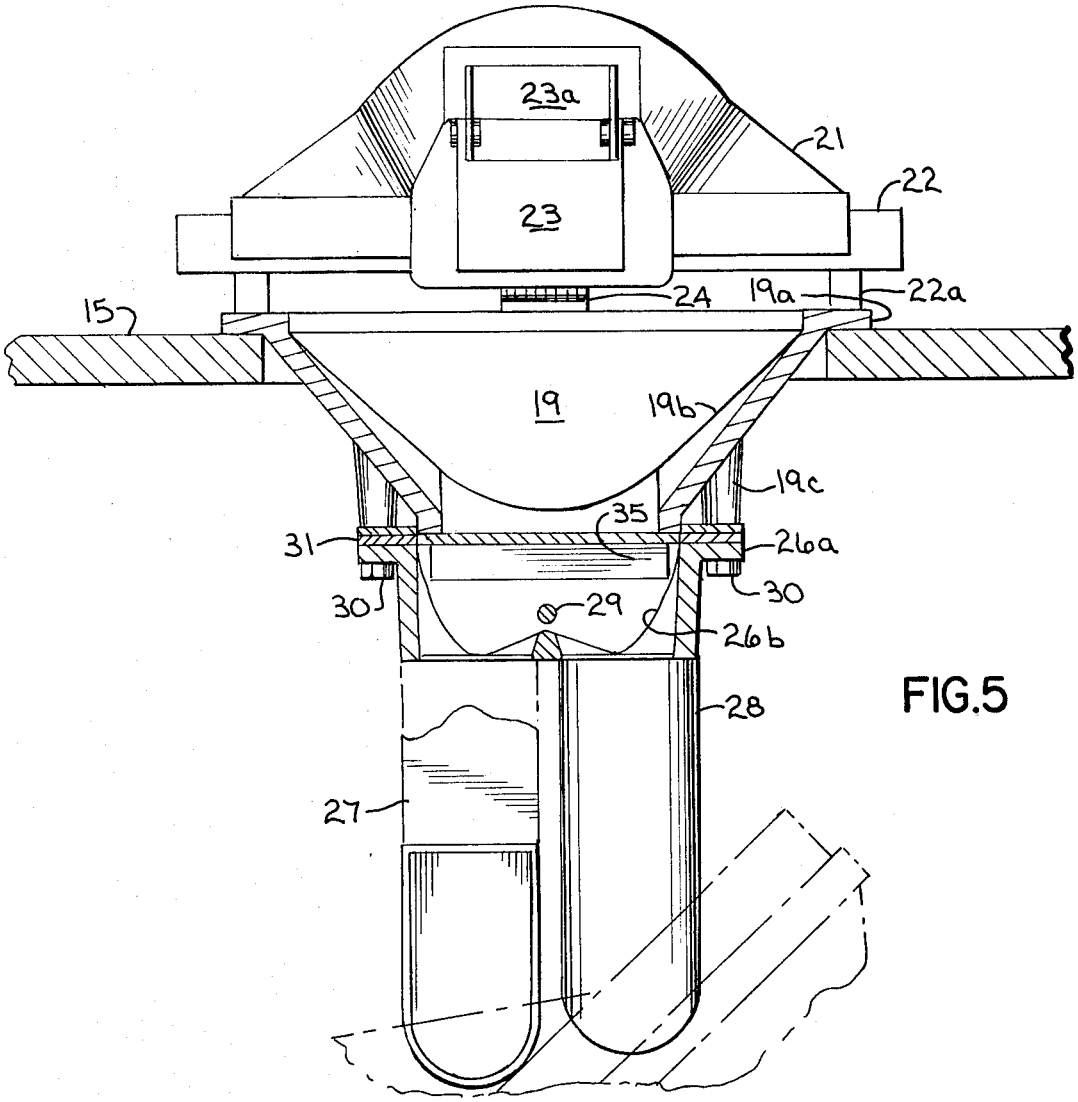
FIG. 5 is a sectional view taken in the plane indicated by line 5—5 in FIG. 3.
Figure 3:
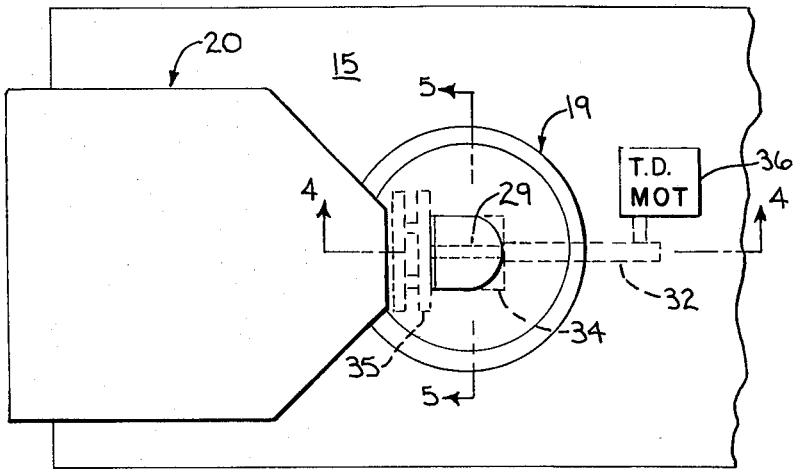
FIG. 3 is a fragmentary top view of the machine of FIG. 1.
Figure 9:
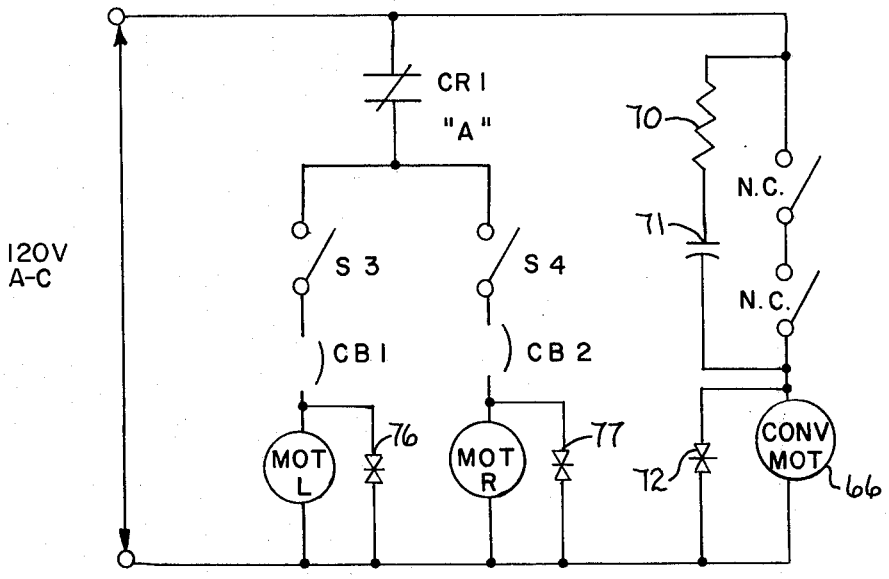
FIG. 9 is an electrical schematic diagram of a circuit for controlling the motor-driven conveyor seen in FIG. 8.

To the left of the totalizer 16 in FIG. 1 is a storage hopper 19 formed by a casting with a lip 19*a* around the periphery of its entrance. As seen in FIGS. 4 and 5, the bottom of this lip 19*a* is supported by a portion of the counter top 15 that surrounds an opening through which the hopper 19 depends. The hopper casting is also formed with a funnel portion 19*b* that narrows as it extends from its circular entrance to an exit at its lower end. As seen in FIG. 3, the right half of this exit is approximately circular while the left half is approximately rectangular, the opening having an axis of symmetry parallel to the longitudinal horizontal axis of the cabinet 13.

To the left of the hopper 19 in FIGS. 1 and 2 is a receptacle 20 with a cowl 21 attached to two rails of an inspection pan 22 that converge towards a rectangular doorway formed by the cowl 21 and the inspection pan 22 above the left side of the storage hopper 19. The bottom of the inspection pan 22 expands rearwardly from the doorway into a rectangular portion with low rails to contain the coins placed therein. The bottom of the inspection pan 22 is apertured as is customary to allow small bits of debris to be separated from the coins during an inspection operation. Referring to FIGS. 4 and 5, a receptacle door 23 is pivotably mounted at its top to a door hinge plate 23*a* on the cowl 21. Just below and inward of the doorway, the inspection pan 22 is mounted on a hinge 24 while the wider, opposite end of the pan 22 extends over the left end of the counter top 15 and has depending supports 22*a* which can be lifted with that end to allow coins to slide out the doorway into the storage hopper 19. As seen in FIG. 4, the metal doorwary 23 is held in a vertical position by the force of gravity as the receptacle 20 is tipped, providing space between the doorway and the door 23 for coins to escape into the storage hopper 19.

Referring to FIGS. 4 and 5, the exit end of the storage hopper 19 is directed toward a coin splitting chute assembly 25, which is an assembly of a coin chute casting 26 and a pair of diverging spouts 27 and 28 angling at 30°–40° below the horizontal, the spout 27 angling downwardly and to the right being attached to the chute casting 26 forward of the spout 28 angling downward and to the left. The chute casting 26 extends downwardly from a flange 26*a* at its mouth to form a throat 26*b* in which a splitting rod 29 is mounted parallel to the horizontal longitudinal axis of the cabinet 11, as seen in FIG. 3, and between the openings to the divergent spouts 27 and 28. When a batch of coins is allowed to flow through the throat 26*b* of the coin chute assembly 25 the first portion will be directed into the front spout 27 and a substantially equal portion will be directed into the rear spout 28. As seen best in FIG. 5, the coin chute casting 26 is mounted to bosses 19*c* formed at four corners of the storage hopper 19 with bolts 30 that extend upwardly through the flange 26*a* on the chute casting 26 and through a mounting plate 31 sandwiched between the chute casting 26 and the hopper 19. This mounting plate 31 has an aperture in which the exit end of the hopper 19 is positioned to communicate with the mouth of the chute casting 26.

Referring to FIG. 4, the chute casting 26 has an opening in its right sidewall through which a rack 32 extends from its engagement with a spur gear 33 on a motor output shaft to support a trap door 34 for the hopper 19. The rack 32 is driven back and forth to move the sliding trap door 34 between an open position and a closed position. When the trap door 34 is in its closed position, a downwardly extending flange 34*a* abuts a spring-urged shut-off device 35 mounted in the left side of the chute casting 26 and along the straight side of the hopper exit (as seen in phantom in FIG. 3). The shut-off device 35 is responsive to contact by the trap door 34 to mechanically actuate a switch S7 on the mounting plate 31 to shut off the motor 36. The contacts of switch S7 are opened when the rack 32 leaves its "home position" and these contacts are closed when the rack 32 mechanically actuates the switch S7 upon its return to position. A second normally closed switch S6 is mounted with the motor 36 on a support bracket 37. Its contacts are opened when the rack 32 reaches a "far" position and are closed whenever the rack leaves the "far" position.

Figure 10:
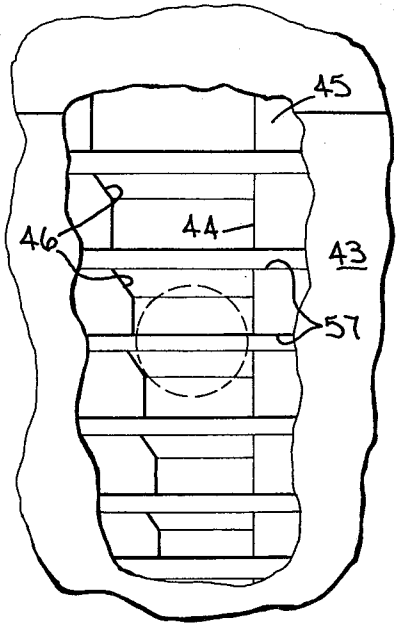
FIG. 10 is a detail side view of the coin sorter used in the machines of FIGS. 2 and 8.

Referring again to FIG. 2, when a batch of coins flows through the coin splitting chute assembly 25, the first portion will be directed through the exit from the forward spout 27 to a coin sorter 38 positioned to the right of the hopper 19 and a second, substantially equal portion will be directed through the exit of the other coin spout 28 to a second coin sorter 39. These are "core" coin sorters of the type described in Buchholz et al., U.S. Pat. No. 3,196,257, issued July 20, 1965 and Bergman, U.S. Pat. No. 4,275,751, issued June 30, 1981. In the hopper 40 of each coin sorter 38 and 39 there is a scalloped disc 41 which is mounted over a plate on a sorting drum or "core" from which the sorter derives its designation. The core is in turn mounted upon a centrally disposed shaft 42 and rotates within a stationary shell 43. The sorter hopper 40 is supported at an angle so that coins to be sorted may be carried upwardly by the scalloped disc 41 and, as seen in FIG. 10, allowed to drop through the outlet opening into a series of vertical coin sorting slots 44 formed on the periphery of the sorting drum or core 45. The width of the coin sorting slots decreases from top to bottom, with inclined shelves or ledges 46 forming a series of graduated stops for arresting coins of different denominations. As the drum is revolved, one coin at a time from the sorter hopper 40 finds its way into one of these slots 44, and as it drops, it is caught by one or the other of the ledges 46 depending on the denomination of the coin. The coin is then carried by the drum 45 until picked off as described below and deposited in drawers 47 seen below the cabinet doors 13 in FIG. 1. As seen in FIG. 2, bag spouts 48 may be attached to the drawers 47 to direct the coins for each respective denomination into corresponding bags 49.

Figure 11:
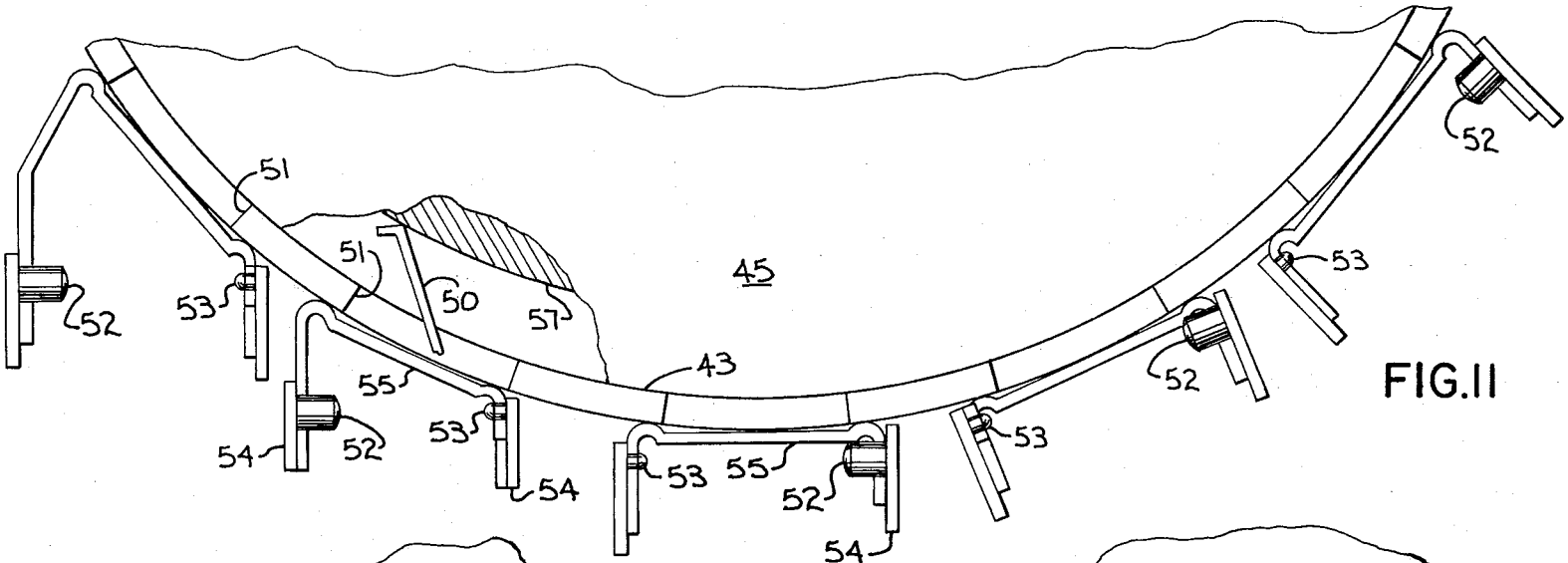
FIG. 11 is a detail top view of a counting mechanism in the coin sorter used in the machines of FIGS. 2 and 8.
Figure 12:
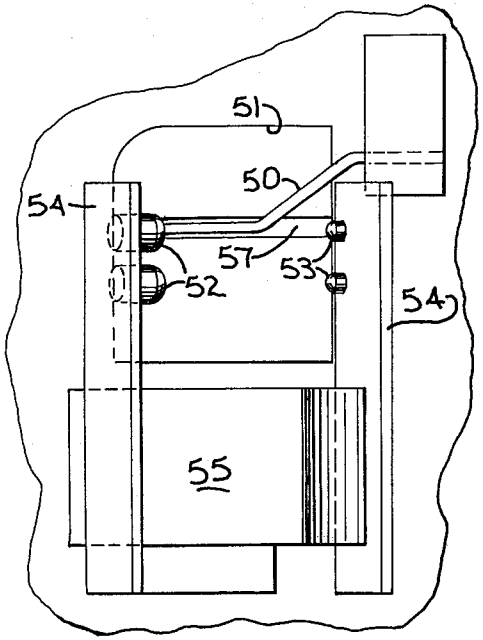
FIG. 12 is a detail front view of a section of the counting mechanism of FIG. 11.

Referring to FIGS. 10–12, after the coins have been sorted into various denominations via the drum 45, they are picked off by wire forms or plows 50, which are mounted on the stationary shell 43 in which the drum 45 rotates. The plows 50 are mounted on the outside of the shell 43 and extend through windows 51 into annular grooves 57 around the circumference of the drum 45. The coins are directed through the windows 51, which are at different heights for the respective denominations, and then drop past photoelectric receiving elements 52 which register a count pulse in response to interruptions of light from light emitting diodes (LEDs) 53. Two photoelectric receiving elements 52 are mounted opposite two LEDs 53 on extending members 54 supported by a bracket 55 that is attached to the shell 43 adjacent each window 51. This arrangement requires the light from two LEDs 53 to be interrupted simultaneously to generate a count pulse, thereby preventing bits of debris smaller than a coin from generating a false current pulse. The brackets 55 are formed in different shapes for the respective denominations. As seen in FIG. 10, dollar coins are received through the leftmost window 51, and progressing to the right, quarters, nickels, pennies and dimes are received through the respective windows 51. A fifty-cent window 51 to the left of the dollar window 51 is not shown.

Figure 6:
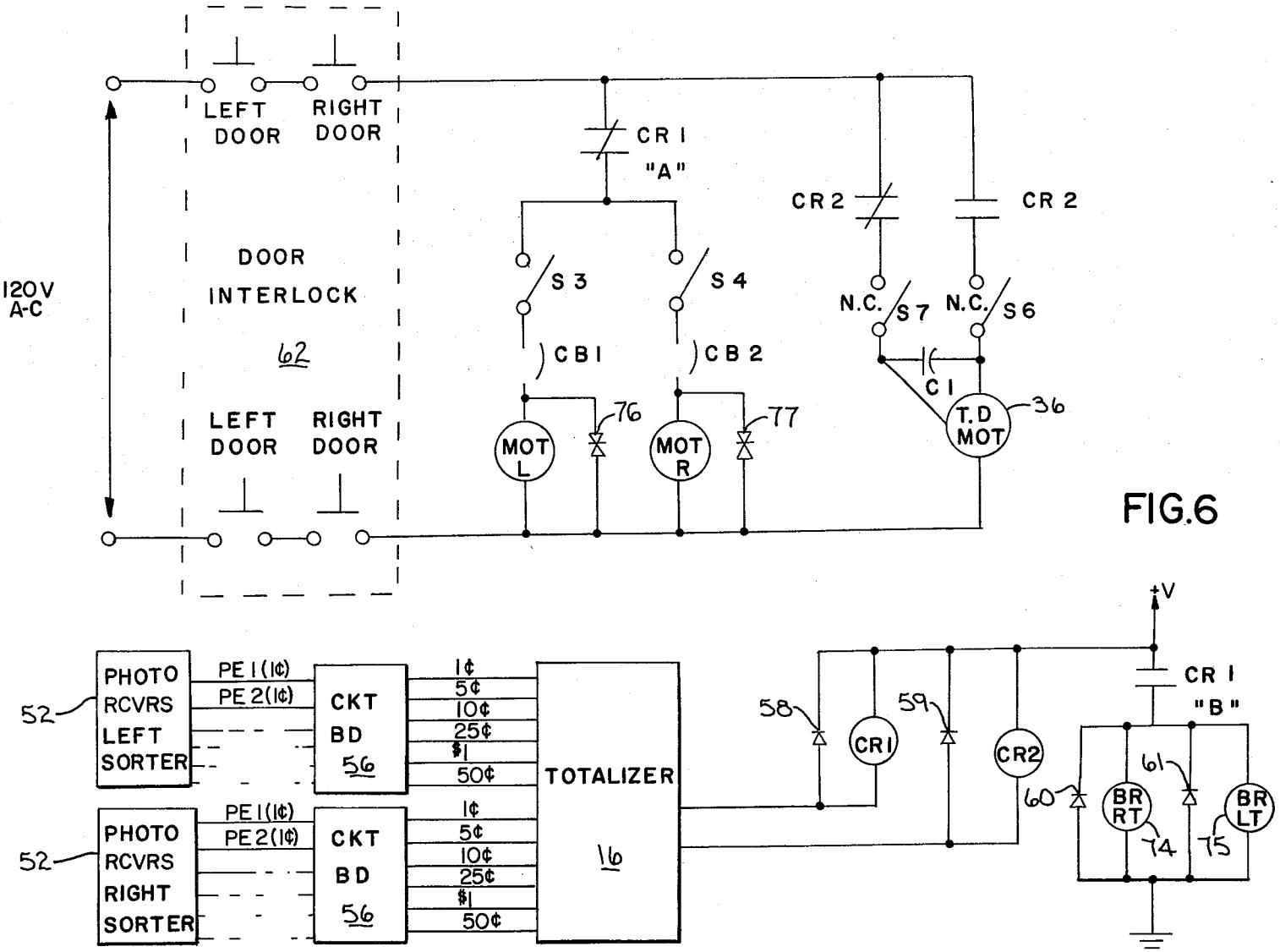
FIG. 6 is an electrical schematic diagram of a control circuit for the machine of FIG. 1.
Figure 7:
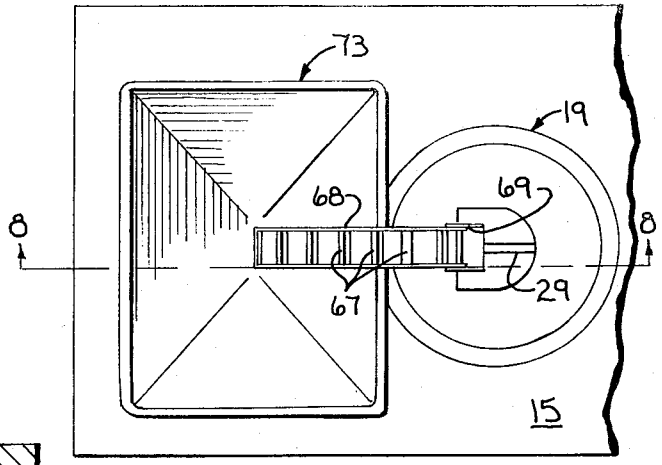
FIG. 7 is a fragmentary top view of a second embodiment of the invention.
Figure 8:
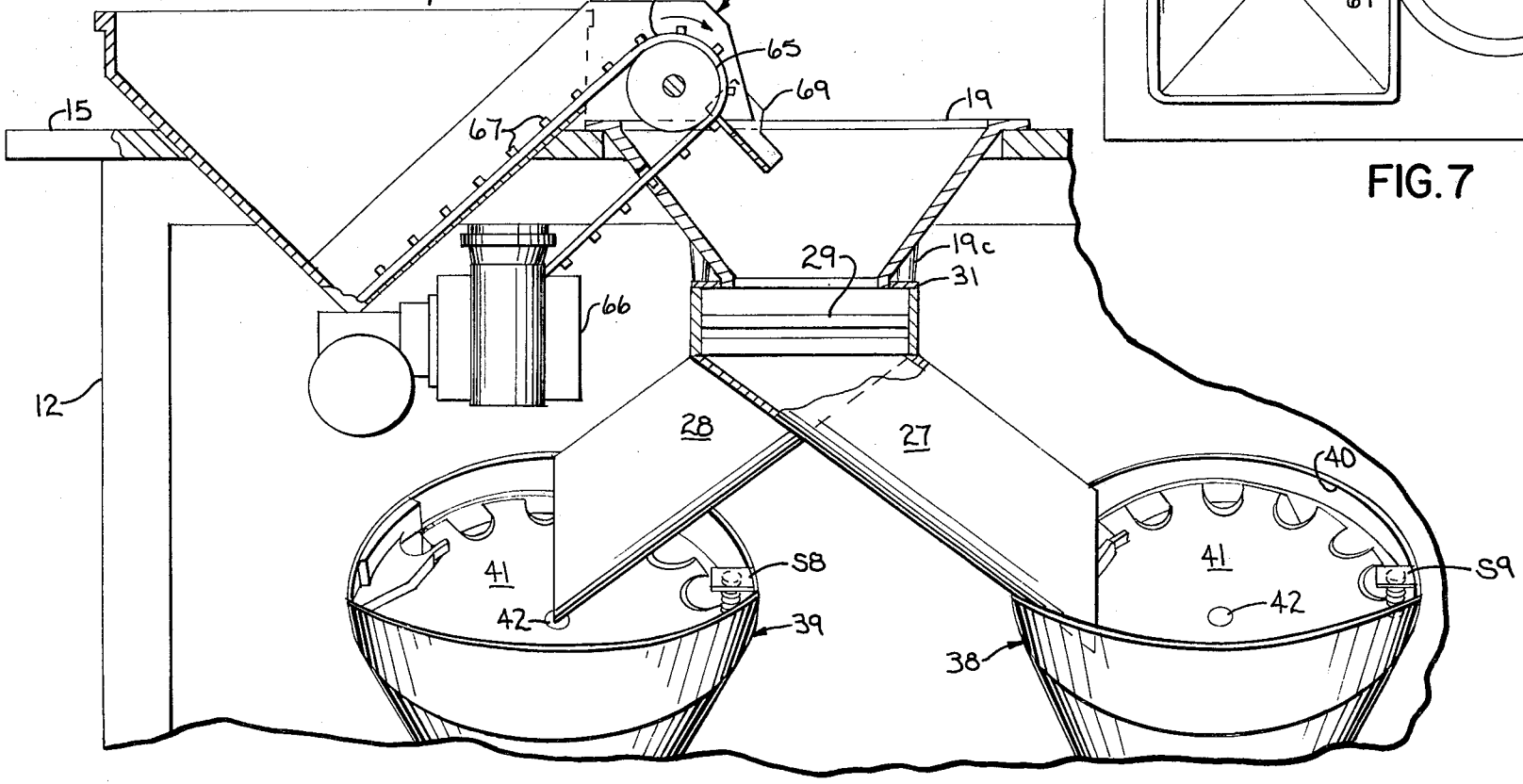
FIG. 8 is a sectional view taken in the plane indicated by line 8—8 in FIG. 7.

Referring to FIG. 6, the manner in which the trap door 34 is opened and closed in response to the completion of sorting and counting a first batch of coins will be described. For each sorter 38 and 39 and for each denomination, 1 cent, 5 cents, 10 cents, 25 cents and 1 dollar, if applicable, two photocells 52 provide signals at inputs PE1 and PE2. These inputs are coupled through circuit boards 56 to the sorters 38 and 39. The circuit boards 56 include logic circuitry assuring that both photoelectric cells for a given denomination have generated input pulses before an output count pulse is coupled to an input on the totalizer 16. Either high-true AND gates or low-true OR gates can be used according to the high or low logic state selected for input pulses from the photoelectric receiving elements 52. The totalizer 16 includes a programmed microprocessor (not shown) that accumulates these count pulses and generates results through the LED display 17 and printer 18. The totalizer 16 is also responsive to the absence of input count pulses for a 5-second delay period to operate the trap door 34 through a control relay CR2 connected through the control circuit of FIG. 6 to the trap door motor (T.D. MOT) 36.

As seen in FIG. 6, the coils of relays CR1 and CR2 are connected in a d-c control circuit that receives signals from outputs on the totalizer 16. Each of the relay coils is connected on one side to a positive d-c voltage source and on the other side to a respective output on the totalizer. Diodes 58 and 59 are connected across these coils CR1 and CR2 to protect them against reverse voltages. A pair of drum brake actuators 74 and 75 are also connected to the d-c voltage source through a "B" set of contacts in the CR1 relay. Protective diodes 60 and 61 are also connected across these brake actuators 74 and 75.

The trap door motor 36 receives power from a 120-volt a-c source through the CR2 relay contacts, which are controlled through the energizing and deenergizing of the CR2 relay coil. The trap door motor 36 is connected across the power source with a first input terminal in series with a normally open set of CR2 contacts and a normally closed switch S6. The trap door motor 36 has a second input terminal connected through the normally closed switch S7 and a normally closed set of CR2 contacts. A capacitor C1 has a positive plate connected to the second input terminal on the trap door motor 36 and a negative plate connected to the first input terminal on the trap door motor 36. With the trap door 34 closed the rack 32 mechanically actuates the switch S7 to open its contacts and prevent the trap door motor 36 from being turned on.

The operation of the trap door 34 must be coordinated with the operation of the coin sorters 38 and 39. The motors for the coin sorters, "MOT L" and "MOT R" are connected through an "A" set of contacts in the CR1 relay to control power thereto. Each of these motors is also connected in series with a respective switch S3 and S4 (also seen in FIG. 1) and a circuit breaker CB1 and CB2. Varistors 76 and 77 are connected across the sorter motors MOT R and MOT L to prevent them from generating voltage spikes within the circuit. The a-c power source is also connected to the above mentioned motors through the door interlock 62 mentioned earlier in the description.

The sequence of control operations in feeding a second batch of coins to the coin sorters 38 and 39 proceeds as follows. When the totalizer 16 senses that the count pulses have not been received at its inputs for the 5-second delay period, and assuming no fault conditions, it generates a logic low output signal to energize the coil of the CR2 relay, which is energized to apply power to the trap door motor 36. The rack 32 and trap door 34 are driven from the home position to the far position which mechanically actuates the switch S6 to open its contacts and shut off the trap door motor 36. In the far position the trap door 34 is open so that a second batch of coins is delivered to the coin sorters 38 and 39. After a time delay from the opening of the switch S6, interrupt signal to interrupt power to the motor-driven coin conveyor and to interrupt the flow of coins through the coin chute, thereby defining the first batch of coins which is processed by the coin sorters.

5. The coin processing apparatus of claim 4, wherein the circuit means coupled between the sensor means and the motor-driven coin conveyor is responsive to the termination of the feed interrupt signal to switch power back to the motor-driven coin conveyor to begin feeding a second batch of coins to the coin chute and the two coin sorters.

* * * * *